US006092949A

United States Patent [19]

Koyabu et al.

[11] Patent Number: 6,092,949

[45] **Date of Patent: *Jul. 25, 2000**

[54] PRINTER WITH A MOVABLE PAPER GUIDE MECHANISM AND METHOD OF SETTING RECORDING PAPER IN SUCH PRINTER

[75] Inventors: Akira Koyabu, Shiojiri; Tsutomu Momose, Okaya; Kenichi Hirabayashi, Suwa, all of Japan

[73] Assignee: Seiko Epson Corporation, Tokyo, Japan

[ * ] Notice: This patent is subject to a terminal disclaimer.

[21] Appl. No.: 09/075,514

[22] Filed: May 8, 1998

[30] Foreign Application Priority Data

May 8, 1997 [JP] Japan ..... 9-118505

[51] Int. Cl.[7] ..... B41J 13/14

[52] U.S. Cl. ..... 400/642; 400/647

[58] Field of Search ..... 400/642, 645, 400/645.3, 647, 645.1

[56] References Cited

U.S. PATENT DOCUMENTS

| | | | |
|---|---|---|---|
| 5,061,095 | 10/1991 | Asai et al. | 400/605 |
| 5,149,217 | 9/1992 | Narita | 400/608.4 |
| 5,161,905 | 11/1992 | Eriksson et al. | 400/637.1 |
| 5,308,175 | 5/1994 | Ito | 400/605 |
| 5,328,281 | 7/1994 | Narita et al. | 400/605 |
| 5,664,895 | 9/1997 | Asai et al. | 400/248.1 |
| 5,863,139 | 1/1999 | Asai et al. | 400/248.1 |

FOREIGN PATENT DOCUMENTS

| | | |
|---|---|---|
| 0 472 218 A2 | 2/1992 | European Pat. Off. . |
| 2 720 331 | 12/1995 | France . |
| 2-219672 | 9/1990 | Japan . |

*Primary Examiner*—Stephen R. Funk
*Assistant Examiner*—Minh H. Chau

[57] ABSTRACT

Disclosed is a printer comprising a paper guide surface (11D) defining a printing region. A print head (8) is disposed opposite to the paper guide surface (11D) with a gap in between and adapted to move in parallel to the paper guide surface (11D) along the printing region (11) and beyond the printing region (11) into a retracted position (11C). A paper guide guides recording paper (5) to the printing region (11) and exposing it to the print head (8) in the printing region. The paper guide includes a guide plate (31) movable between a first position in which it is disposed opposite to the paper guide surface (11D) so as to guide recording paper (5) past the printing region (11), and a second position in which it is retracted from the printing region. A first pair of rollers is switchable between a closed state engaging each other for transporting the recording paper (5) to the printing region (11), and an open state separated from each other. A first mechanism (34–38) moves the guide plate (31) into the first position and returns it into the second position. A second mechanism (43–46) switches the rollers (41*a,* 41*b*) between the closed state and the open state, and a motor (32) drives both the first mechanism and the second mechanism so as to bring the first pair of rollers (41*a,* 41*b*) into the closed state and move the guide plate (31) from the second to the first position in a sequential order.

13 Claims, 10 Drawing Sheets

PRINTER WITH A MOVABLE PAPER GUIDE MECHANISM AND METHOD OF SETTING RECORDING PAPER IN SUCH PRINTER

CROSS REFERENCE TO RELATED APPLICATIONS

This application is related to the following commonly-assigned, co-pending application:

"Printer With A Movable Paper Guide Mechanism And Method Of Setting Recording Paper In Such Printer" by Akira Koyabu, Tsutomu Momose, Kenichi Hirabayashi, filed on even date herewith and assigned Ser. No. 09/075,513, the contents of which are incorporated herein by reference.

BACKGROUND OF THE INVENTION

1. Field of the Invention

The present invention relates to a printer in which a print head is moved in a reciprocating manner along a printing region defined by a paper guide surface and prints on recording paper transported along the paper guide surface through the printing region. The invention also relates to a method of automatically setting recording paper in such printer.

2. Description of the Related Art

Cash registers used, for example, as point of sale (POS) terminals are generally equipped with a printer for printing on roll paper. After printing, for example, the purchase price of merchandise, the amount received, and the amount of change returned, the printed roll paper can be cut or torn off and issued as a receipt.

A paper guide surface defining the printing region or printing position of the print head is formed at a midpoint in the transportation path of the roll paper in such a printer, and the print head is held opposite to the paper guide surface. More precisely, part of the transportation path is open to expose the roll paper to the print head and to enable printing by the print head on roll paper.

When the leading edge of newly loaded roll paper is transported along this transportation path during roll paper replacement, only one side is guided by the paper guide surface at this open part of the transportation path. The leading edge of the roll paper thus tends to curve to the open side, that is, toward the print head, to leave the transportation path and, thereby, to cause a paper jam. Paper jams occur particularly easily at this type of printing position when the leading edge of the roll paper is curled or folded.

To avoid such paper jams during roll paper replacement, a roll paper setting mechanism for a printer disclosed in JP 2-219672/1990 A is designed to close the open part of the transportation path on the print head side by means of a movable guide when the roll paper is replaced. When an auto-load switch is operated for roll paper replacement, the print head is tilted backward to increase the gap between the print head and the platen, and the movable guide is moved into the thus widened transportation path. This limits the transportation path to a path in which both sides are closed by means of said movable guide and the platen, respectively, and the leading edge of the roll paper is guided along this transportation path to the exit side.

Because a transportation path of which both sides are closed is temporarily formed by thus moving a movable guide, the leading edge of the roll paper can be reliably passed to the transportation path on the exit side. In addition, after roll paper replacement is completed, the movable guide is retracted from the position opposing the platen, the platen returns to a condition opposing the print head, and printing by means of the print head to the roll paper as it is transported along the platen is again made possible.

In this prior art, a mechanism for tilting the print head in a direction away from the platen, i.e., about an axis parallel to the direction in which the print head moves for printing, is required and space must be provided to allow for such tilting of the print head. This arrangement invites corresponding increases in the size and cost of the device.

In addition, print heads are normally designed to achieve an optimum printing operation when held at a predefined platen gap. Therefore, a tilting movement of the print head as explained above which changes the positional relationship between the print head and the platen that determines the platen gap is not desirable. If the return position of the print head due to backlash for instance is not accurately controlled a change in the platen gap will result. It is particularly necessary to maintain a constant platen gap when an ink jet head is used as the print head, in which case even momentarily moving the print head in a direction to retract it from the platen is not desirable.

Furthermore, there are also cases with a cash register where it is necessary to print on cut-sheet forms and other slip forms that are wider than the roll paper. Unlike the cut-sheet forms typically used in a corporate office, slip forms used as the recording paper in this case in supermarkets, convenience stores, and similar locations often have wrinkles, curls, or creases. As a result, even with slip forms the leading edge of the transported recording paper tends to separate from the surface of the platen or other part of the transportation path, resulting in a paper jam at that point similar to the situation that occurs when roll paper is replaced.

In order to facilitate setting slip forms easily and correctly in slip printers, such printers are normally equipped with a mechanism for switching paper feed rollers between a closed state engaging each other and an open state separated from each other, a paper stop and a mechanism for moving the paper stop. While applying the movable guide disclosed in JP 2-219672/1990 to such slip printer might be helpful to set the slip forms more correctly, providing respective mechanisms for moving or switching the guide, the paper stop and the feed rollers would increases the printer size. Further, controlling these mechanisms for setting a slip form would become rather complicated.

OBJECTS OF THE INVENTION

Therefore, it is an object of the present invention to overcome the aforementioned problems.

It is another object of the present invention to provide a printer with a movable paper guide capable of transporting recording paper without causing a paper jam to occur at the printing region and without requiring the print head to be tilted away from the platen or a paper guide surface functioning as a platen.

A further object of the invention is to provide a method of automatically setting recording paper in such printer.

It is another object of the present invention to provide a printer with a movable paper guide, which is capable of automatically loading slip forms to the printing region without causing an increase in the size of the printer or complicating the control for setting a slip form.

SUMMARY OF THE INVENTION

In a printer according to the present invention, a guide plate is caused to appear, i.e. to be activated, only when a print head is retracted to a retraction position outside of a printing region, and a paper transportation path of which both sides are defined by the guide plate and a paper guide surface, respectively, is formed. As a result, even if the leading edge of the recording paper is curled, folded, or wrinkled, the recording paper will be reliably transported along this paper transportation path temporarily formed with both sides closed even at the printing region. In addition, the print head is retracted to the retraction position in the direction of carriage movement, thereby (1) maintaining a constant gap to the paper guide surface and (2) eliminating the need to provide a separate print head moving mechanism for the purpose of retracting the print head.

In addition, if the range covered by the reciprocating movement of the print head carried by the carriage mechanism is increased in the printer according to the present invention, the width of the printing region within which the print head can print also increases. As a result, printing to both narrow roll paper and wide slip forms is possible, and wide slip forms can also be transported without a paper jam occurring.

In a printer according to the present invention the guide plate is preferably moved parallel to the paper guide surface to consistently ensure reliable recording paper transportation.

Furthermore, the guide plate preferably comprises a paper presser surface extending towards the surface of the paper guide, the paper presser surface being a continuous surface with a width greater than the maximum width of the transported recording paper. By thus forming the paper presser surface, recording paper with wrinkles and curls can be transported more smoothly compared with a configuration in which a roller or other paper presser member is disposed in part across the width of the transported recording paper.

In addition, the paper presser surface of the guide plate is preferably pushed constantly in the direction of the paper guide surface by force of a spring, thereby preventing the transported recording paper from lifting off the paper guide surface.

In accordance with a further embodiment of the present invention, a printer is provided with a movable paper guide which is capable of automatically loading slip forms to the printing region without causing an increase in the size of the printer or complicating the control for setting a slip form.

Other objects and attainments together with a fuller understanding of the invention will become apparent and appreciated by referring to the following description and claims taken in conjunction with the accompanying drawings.

BRIEF DESCRIPTION OF THE DRAWINGS

Preferred embodiments of the invention will be described in detail below with reference to the drawings in which.

DESCRIPTION OF THE PREFERRED EMBODIMENTS

General Configuration of Printer

Figure 1:
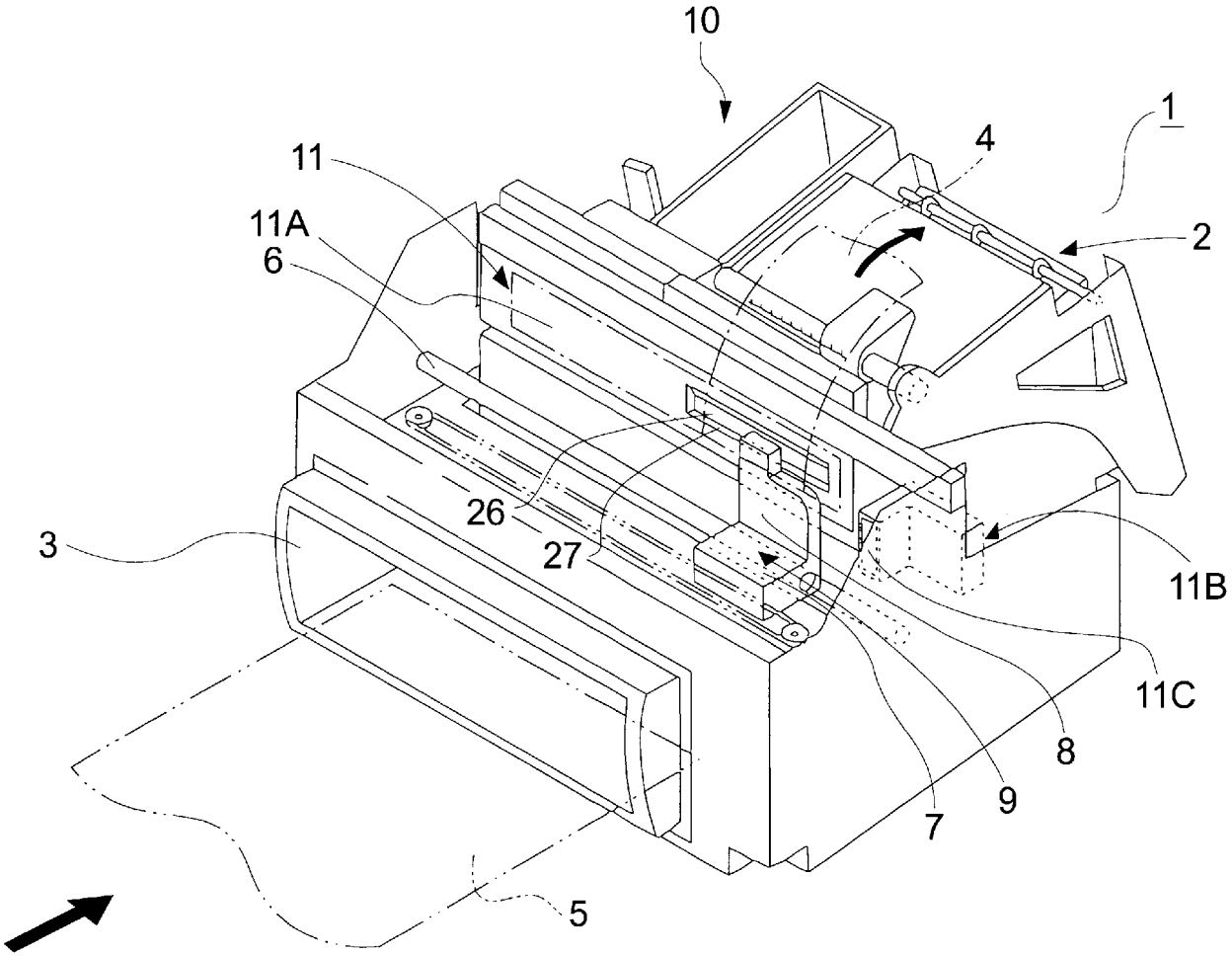
FIG. 1 is a perspective view of an ink jet printer embodying the present invention.
Figure 2:
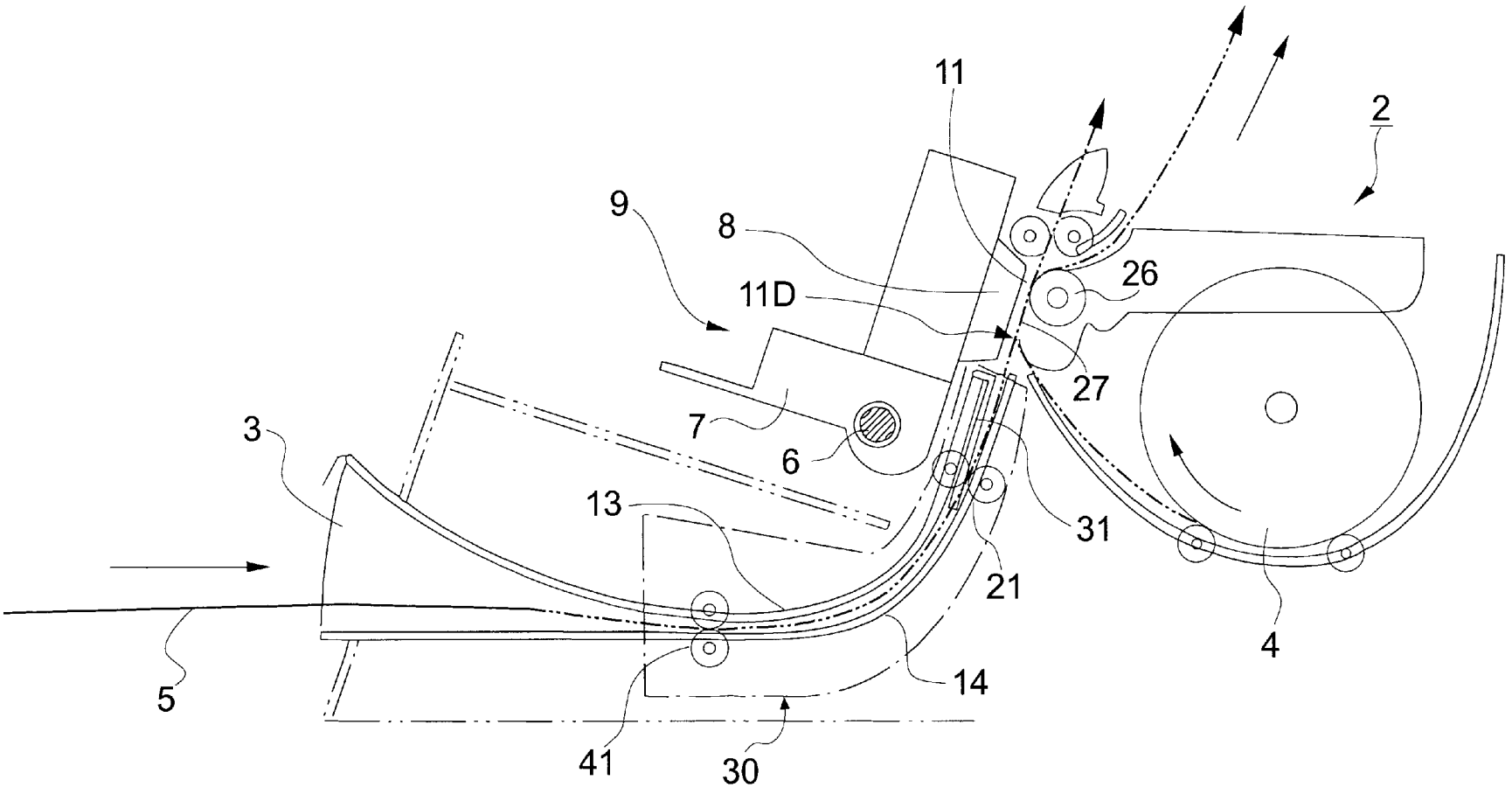
FIG. 2 is an explanatory drawing of the paper transportation path in the printer shown in FIG. 1.

Referring to FIGS. 1 and 2, ink jet printer 1 is adapted to print selectively either on roll paper 4 (recording medium) or on cut-sheet paper 5 (recording medium) such as A4 size cut sheets, slip forms, and others (simply referred to as "slip forms" hereinafter). A supply of roll paper is accommodated in a roll paper storage compartment 2, while slip forms are inserted into a paper supply opening 3. Respective transportation paths are formed in the printer through which roll paper 4 supplied from roll paper storage compartment 2 and slip forms 5 inserted into the paper supply opening 3 can be transported to and past a printing region 11 (the area enclosed by a dot-dash line in FIG. 1). An ink jet head 8 is supported by a carriage mechanism 9 in a manner so as to face the surface of the recording paper (roll paper 4 or slip form 5) as the recording paper passes printing region 11.

The carriage mechanism 9 comprises a guide shaft 6, a carriage 7 supported so as to be movable in a reciprocating manner along this guide shaft 6, and a motor (not shown in the figure) for driving the carriage. The axial direction of guide shaft 6, i.e., the direction of the reciprocating movement of the carriage 7 will be referred to as X direction in the following. The X direction is perpendicular to the transportation direction of the recording paper and parallel to the surface of the recording paper at the printing region 11. Ink is supplied to the ink jet head 8 from an ink supply unit 10, which is mounted at a position adjacent to roll paper storage compartment 2, through an ink tube (not shown in the figure).

As is best shown in FIG. 1, the printing region 11 is divided in the lateral direction (the X direction) into two subregions. The printing subregion on the right hand side in FIG. 1 is defined by a platen roller 26 and a paper guide 27 which forms a surface smoothly continuous to the platen roller 26. The printing subregion on the left hand side in FIG. 1 is defined by paper guide member 11A which has smooth surface. The right hand side printing subregion is used in common for roll paper 4 and slip forms 5 while the left hand side printing subregion is used only for slip forms 5. The left hand side printing subregion is provided to allow for slip forms having a greater width than that of the roll paper 4. The surface defined by platen roller 26 and paper guide 27 and the surface of paper guide member 11A will be referred to as paper guide surface 11D hereinafter. The part of the paper guide surface 11D that defines the printing region 11, i.e., the region directly opposite to the ink jet head 8 as the latter moves along paper guide surface 11D has the function of a platen.

The carriage 7 can perform a lateral reciprocating motion through a range containing this printing region 11. A capping surface 11C of a capping mechanism 11B, which defines a standby position of ink jet head 8, is disposed adjacent to one lateral end (the right hand side end in the embodiment shown) of printing region 11. During a standby mode, ink jet head 8 is positioned in front of capping surface 11C such that its nozzle surface is covered by capping surface 11C, thereby preventing the ink from drying and retraction of the ink meniscus in each ink nozzle. In addition, as will be described below, in the present embodiment ink jet head 8 is held in this retracted standby position until the leading edge of slip form 5 inserted into the paper supply opening 3 is transported to a position beyond printing region 11.

As shown in FIG. 2, slip form 5 is transported from paper supply opening 3 between upper and lower paper guide plates 13, 14 towards printing region 11, and the printed slip form 5 is then ejected to the outside from printing region 11. A paper supply roller pair 41 is disposed at a position on the downstream side of paper supply opening 3, and a primary feed roller pair 21 is disposed between this paper supply roller pair 41 and the printing region 11. In addition, a paper ejection roller pair 22 is disposed downstream of printing region 11.

A substantial part of the transportation path for slip forms 5 is defined by the pair of guide plates 13, 14 opposing each other with a specified gap therebetween. However, at the printing region 11 the transportation path has an opening on the side facing ink jet head 8 in order to expose the surface of a slip form 5 (or roll paper 4) to the ink jet head and to enable printing on that surface as a slip form 5 (or roll paper 4) passes printing region 11. Because of this opening, when a slip form 5 whose leading edge may be curled, wrinkled, or folded is transported to this opening, such leading edge may leave the transportation path and travel through the opening away from guide surface 11D (the surface defined by platen roller 26, paper guide 27, and the surface of paper guide member 11A) on one side of the printing region 11. The leading edge can thus contact the nozzle surface of ink jet head 8, for example, and thereby cause a paper jam. To avoid this, a guide plate mechanism 30 is provided in the present embodiment in the area enclosed by a dot-dash line in FIG. 2, i.e. in an area from paper supply roller pair 41 to printing region 11. This guide plate mechanism 30 comprises a guide plate 31, which is arranged to be movable to temporarily block or close the opening in the transportation path at printing region 11 until the leading edge of a slip form 5 is transported to a position beyond printing region 11.

When the opening in the transportation path is thus closed, slip form 5 is guided between guide plate 31 and guide surface 11D. As a result, the leading edge of a slip form cannot wander towards the ink jet head 8, and problems such as paper jams cannot occur. In addition, ink jet head 8 is held at its standby position (11C) while the opening is thus covered by guide plate 31.

A control circuit (controller) including, for example, a processor or CPU, a random access memory (RAM) and a read only memory (ROM) for controlling the printer 1, is disposed in a lower part of the printer 1. The controller detects the position of ink jet head 8 and of guide plate 31 and controls guide plate mechanism 30 and carriage mechanism 9 so that ink jet head 8 is held at its standby position (11C) when the guide plate 31 is driven, while the guide plate 31 is held at its retracted position when ink jet head 8 is driven, to prevent the guide plate 31 and the carriage from interfering or colliding with one another.

Guide Plate Mechanism

The configuration of guide plate mechanism 30 is described next with reference primarily to FIGS. 3(A), 3(B), 4(A), 4(B), 5, and 6.

Figure 3:
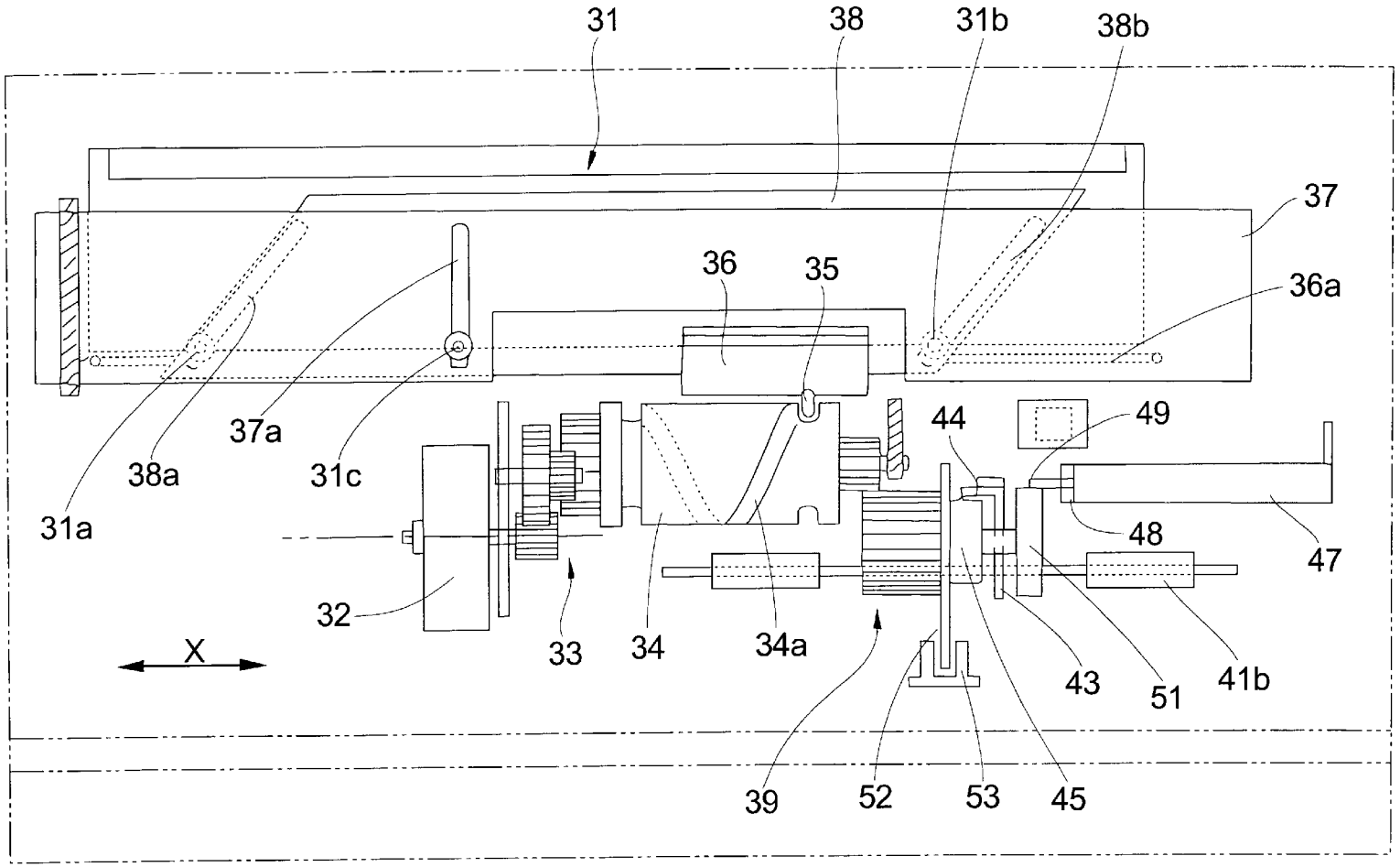
FIG. 3(A) is a plan view and FIG. 3(B) is a side view of the guide plate mechanism in the printer shown in FIG. 1 and shows the guide plate in its second or retracted position.
Figure 3:
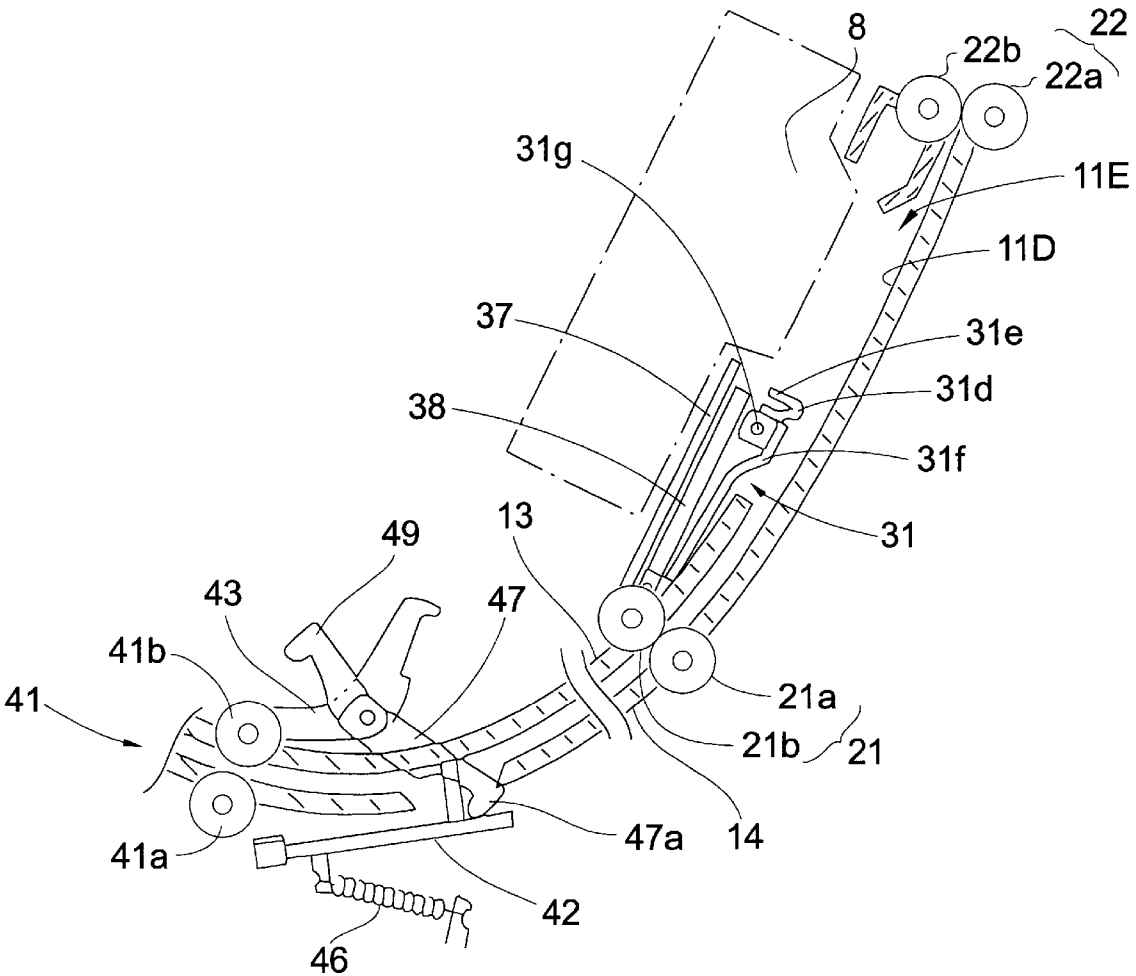
Figure 5:
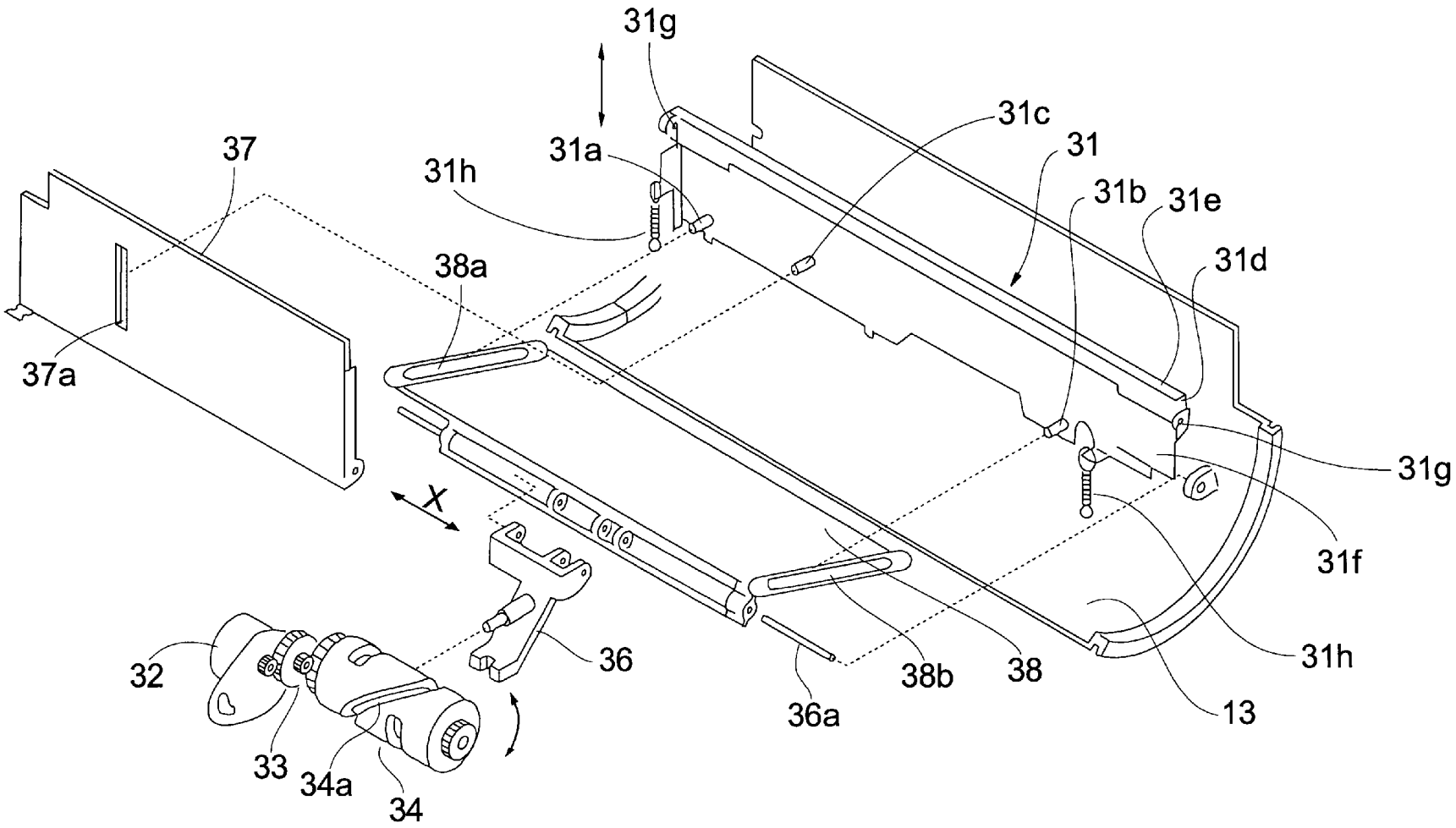
FIG. 5 is a partially exploded perspective view of the drive part of the guide plate of the guide plate mechanism in FIG. 3(A)

FIG. 3(A) is a basic structural diagram of guide plate mechanism 30 provided at a location below carriage mechanism 9. FIG. 3(B) is a basic structural diagram of guide plate mechanism 30 as seen from the side. FIG. 5 is an exploded perspective view of part of guide plate mechanism 30.

As shown in these figures, guide plate mechanism 30 comprises a stepping motor 32 as a drive source. The output shaft of this stepping motor 32 is connected, by way of speed reducing gear assembly 33, to a cylindrical cam 34 whose axis extends in the X direction. A spiral cam groove 34*a* is formed in the peripheral surface of this cylindrical cam 34. A slide pin 35 is engaged with this cam groove 34*a;* and slide pin 35 is fastened to a slider 36, which can slide in the X direction.

The slider 36 can move in a reciprocating manner along a slide shaft 36*a,* which is mounted on a support plate 37. Support plate 37 has a substantially rectangular shape with the longer side extending in the X direction. By appropriately determining the pitch of cam groove 34*a,* one revolution of cam 34 can be made to cause slider 36 to travel from one end of its range of motion to the other end. Referring to FIG. 3(A) as an example, if cam 34 is rotated through 360° or nearly 360° in the appropriate direction from the position shown, slider 36 will move from the right-hand side end of its range of motion to the left-hand side range. If subsequently cam 34 is again rotated through 360° or nearly 360° in the opposite direction, slider 36 will return to its starting position at the right-hand side.

A drive plate 38 is disposed on the back side (the side remote from carriage mechanism 9) of the support plate 37 and connected to slider 36 so as to slide with slider 36. On both sides drive plate 38 has a slanted cam groove 38*a* and 38*b,* respectively, which extend parallel to one another.

The guide plate 31 is disposed on the back side of drive plate 38 and is mounted in a manner enabling its movement relative to support plate 37 in the slip form transportation direction parallel to guide surface 11D. The ends of slide pins 31*a* and 31*b* projecting from a surface of guide plate 31 are slidably inserted into cam grooves 38*a* and 38*b,* respectively. The end of another slide pin 31*c* also projecting from guide plate 31 is slidably inserted into a vertical cam groove 37*a* which extends in the direction of slip form transportation and is formed in support late 37 the position of which is fixed.

Therefore, when cam 34 rotates from the position shown in FIG. 3(A), slider 36 slides (to the left in FIG. 3(A)) in the X direction. As drive plate 38 slides with slider 36, slide pins 31*a* and 31*b* follow the slanted cam grooves 38*a* and 38*b,* respectively, while slide pin 31*c* follows vertical cam groove 37*a* so that guide plate 31 is pushed up vertically, i.e., in the direction of slip form transportation. As a result, guide plate 31 is lifted from its retracted position in which it is hidden behind support plate 37 along guide surface 11D defining printing region 11, to a position opposite guide surface 11D.

Figure 4:
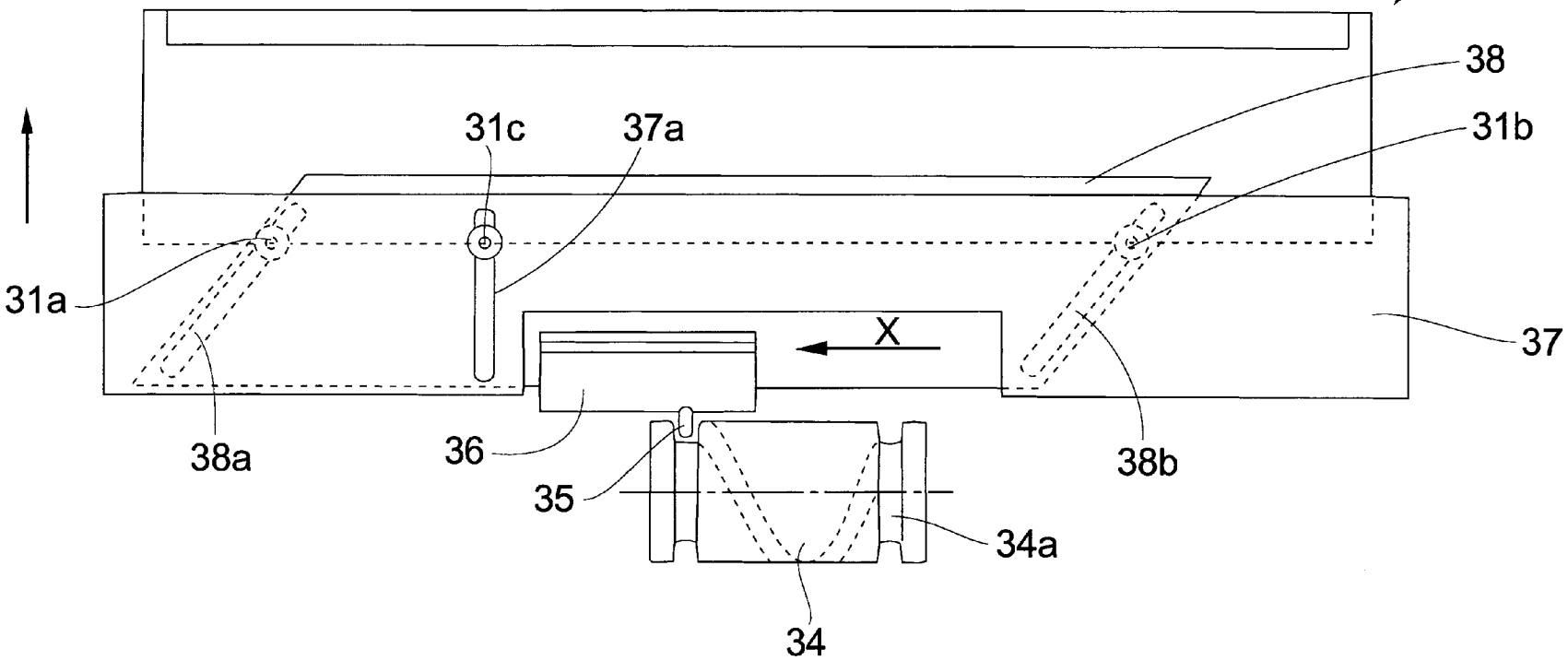
FIG. 4(A) is a plan view and FIG. 4(B) is a side view of the guide plate mechanism in the printer shown in FIG. 1 and shows the guide plate in its first or activated position.
Figure 4:
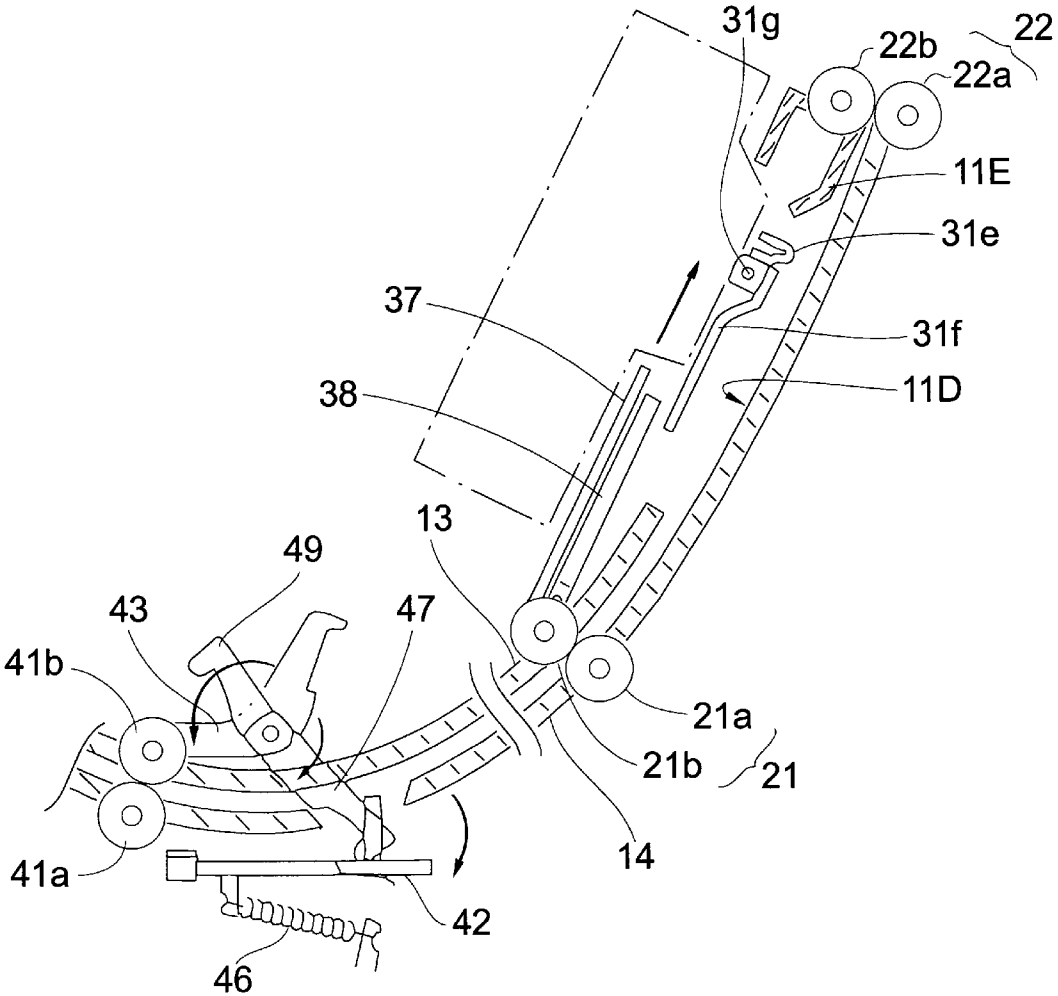

More specifically, as a result of this movement, a state as shown in FIGS. 4(A) and 4(B) is achieved. Therefore, if guide plate 31 is lifted in synchronization with the operation transporting slip form 5, slip form 5 will be guided by guide plate 31 to a transportation path 11E which is formed on the downstream side of printing region 11 in the transportation direction.

As best seen from FIG. 5, guide plate 31 comprises a paper presser 31*e* having a presser surface 31*d* projecting towards guide surface 11D, and support plate 31*f* for supporting the paper presser 31*e*. The presser surface 31*d* of this paper presser 31*e* is a continuous surface of a length (in X direction) sufficient to cover the full width of the transported slip form 5. By means of this presser surface 31*d,* the full width of the transported slip form 5 can be pressed to the guide surface 11D while the form is being transported, and slip forms that are wrinkled or curled, for example, can therefore be smoothly advanced.

Paper presser 31*e* is pivotally attached to support plate 31*f* with the pivot axis defined by holes 31*g* on both sides of support plate 31*f*. A spring attached between paper presser 31*e* and support plate 31*f*, constantly biases presser surface 31*d* of paper presser 31*e* towards guide surface 11D. It is therefore possible by means of this spring to prevent the transported slip form 5 from being advanced while not in contact with guide surface 11D.

When cam 34 rotates from the position shown in FIG. 4(A) to the position shown in FIG. 3(A), the guide plate 31 may not completely return to its retracted position behind support plate 37, because there is backlash between slide pins 31*a*, 31*b* and the corresponding cam grooves 38*a*, 38*b*. To avoid such condition, springs 31*h* (FIG. 5) secured or hooked between support plate 31*f* and upper paper guide plate 13, force guide plate 31 downwards.

Figure 6:
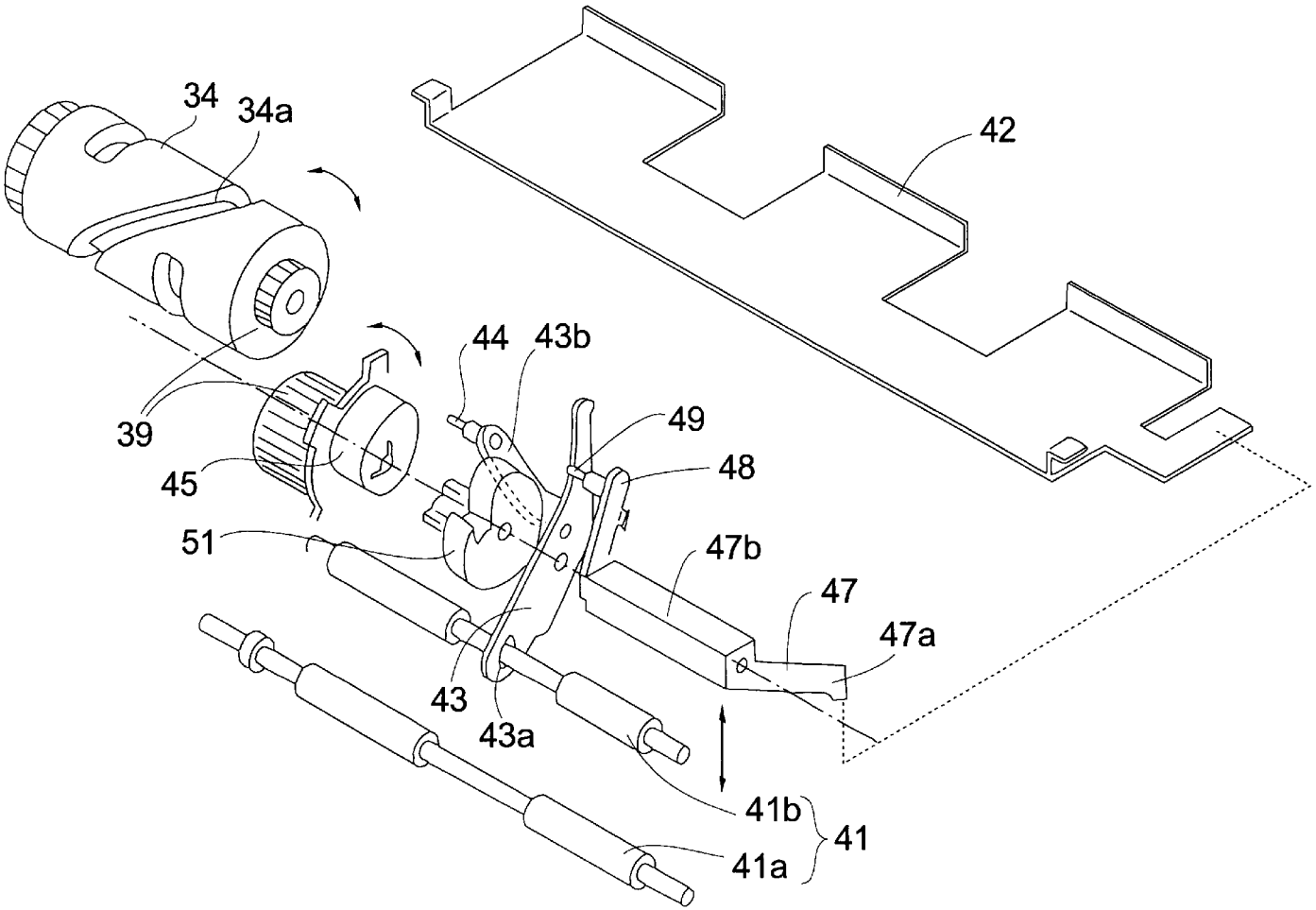
FIG. 6 is a partially exploded perspective view of the drive part of the paper stop and slip form pinch roller coupled to the guide plate mechanism in FIG. 3(A)

Referring to FIG. 4(B), printer 1 according to the present embodiment further comprises the paper supply roller pair 41 and a paper stop 42 arranged in the transportation path in this sequence between the paper supply opening 3 and the printing region 11. An exploded perspective view showing the components of these parts is shown in FIG. 6. The construction of these parts is described with reference primarily to FIGS. 3(A), 3(B) and 6.

First, paper supply roller pair 41 comprises a drive roller 41*a* and a pinch roller 41*b*. Pinch roller 41*b* can move between a contact position in which it contacts drive roller 41*a* with a constant pressure, and a retracted position in which it is separated from drive roller 41*a*. More specifically, pinch roller 41*b* is supported in a freely rotating manner on one end 43*a* of a rotary lever 43. A slide pin 44 is fixed on the other end 43*b* of rotary lever 43 as a cam follower. A spring force holds this slide pin 44 in constant contact with a cam face formed on the peripheral surface of a disk-like cam plate 45. The cam plate 45 is linked to the above-noted cam 34 by means of a gear set 39.

The cam plate 45 therefore turns in conjunction with a rotation of cam 34. When cam plate 45 turns, slide pin 44 moves according to the rotational position of cam plate 45 thereby rotating rotary lever 43 around the center of rotation thereof. As a result, pinch roller 41*b* is moved between the contact position shown in FIG. 4(B) and the retracted position shown in FIG. 3(B).

The paper stop 42 is normally held by the force of coil spring 46 at a position blocking the transportation path as shown in FIG. 3(B). The force of coil spring 46 is adjusted so that when a slip form 5 is in the transportation path and is sandwiched between the top end of paper stop 42, which closes the transportation path, and the paper guide plate 13, slip form 5 can still be transported. Therefore, once slip form 5 has passed paper stop 42, form transportation is no longer affected if paper stop 42 is rotated into its closed position by means of a rotary lever 47 described below, and thereby closes the transportation path.

One end 47*a* of rotary lever 47 is engaged with paper stop 42. This rotary lever 47 rotates integrally with another rotary lever 48, as shown in FIG. 3(A), which is formed on the other end of a connecting part 47*b* therebetween. A slide pin 49 is disposed as a cam follower on the end of rotary lever 48. This slide pin 49 is pressed constantly by the force of a spring against a cam face formed on the peripheral surface of disk-like cam plate 51. The cam plate 51 is linked via cam plate 45 and gear set 39 to the above-noted cam 34.

The cam plate 51 therefore rotates in conjunction with rotation of cam 34, and when cam plate 51 turns, slide pin 49 moves according to the rotational position of cam plate 51 thereby rotating rotary lever 48 around its rotational axis 43*c*. As a result, rotary lever 47 integrated with rotary lever 48 also rotates, and paper stop 42 supported on this lever 47 is moved, against the spring force of spring 46, to the open position at which the transportation path is open as shown in FIG. 4(B).

Slip Form Transportation

Figure 7:
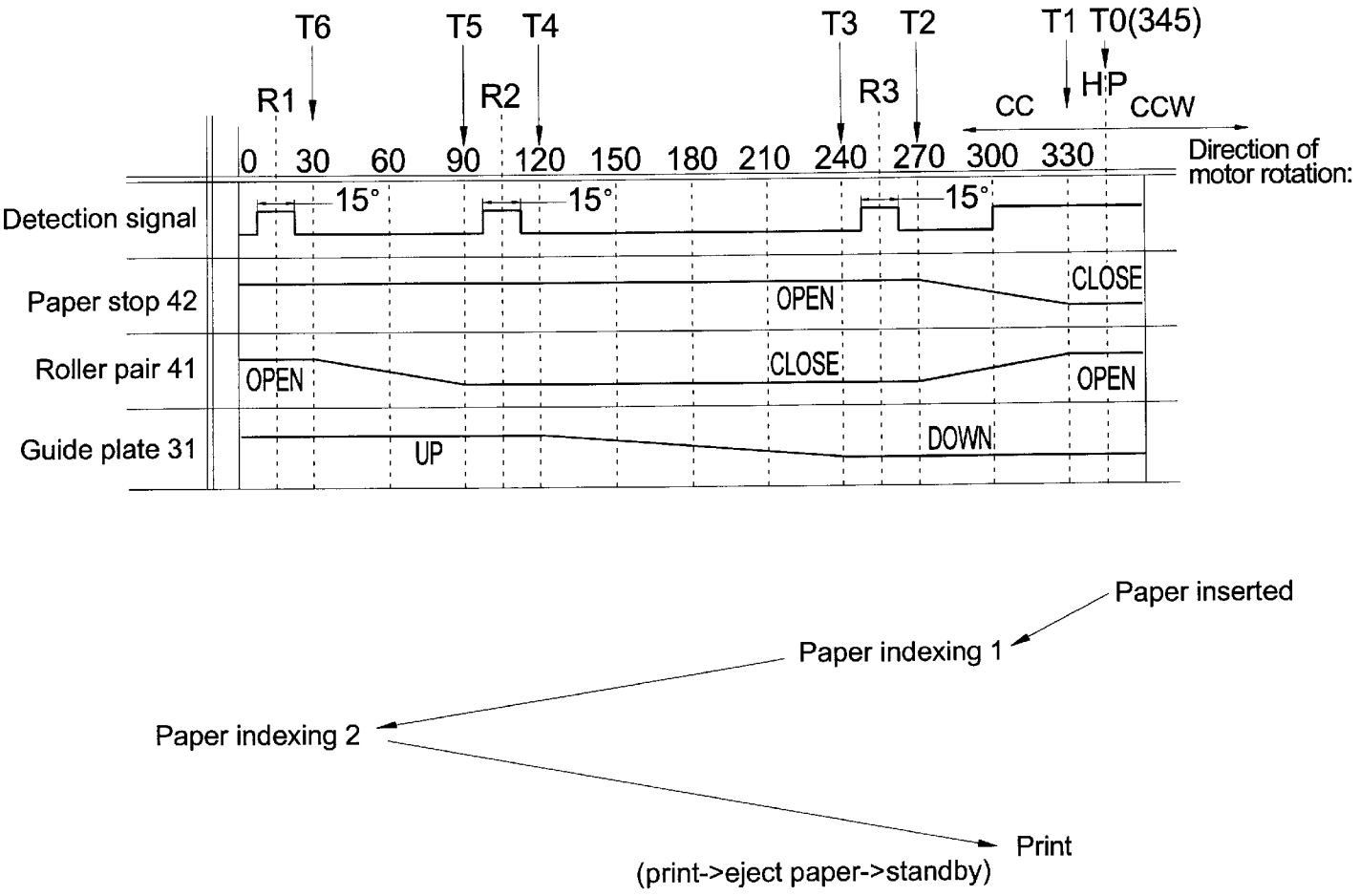
FIG. 7 is a chart used to describe the operation sequence of the guide plate mechanism in FIG. 3(A)

The operation for transporting a slip form inserted to the paper supply opening 3, and particularly the operation of guide plate 31, pinch roller 41*b* and paper stop 42, is described next with reference to the control sequence chart in FIG. 7. FIG. 7 shows the condition of various components against the rotary position of cam 34.

The initialization state T0 which corresponds to a home position HP of the cam 34 (arbitrarily set to a rotary position of 345° in this embodiment) is as follows. The guide plate 31 is in its retracted position hidden behind support plate 37 as shown in FIGS. 3(A) and 3(B). The pinch roller 41*b* is in its retracted position separated from drive roller 41*a*, and paper stop 42 is in its closed position blocking the transportation path. Primary feed roller pair 21 disposed upstream of printing region 11 is always in a contact position in which feed roller 21*a* and pinch roller 21*b* are in contact. On the other hand, paper ejection roller pair 22 disposed downstream of printing region 11 is positioned with feed roller 22*a* and pinch roller 22*b* being separated.

To detect the home position HP as well as predetermined reference positions R1 (15°), R2 (105°) and R3 (255°) of cam 34 and cam plates 45 and 51 which are coupled to each other, a vane 52 that rotates in conjunction with cam plates 45 and 51 is as shown in FIG. 3(A). A detection signal indicative of these positions can then be obtained by detecting the rotary position of this vane 52 using a photocoupler 53 or other type of sensor. As shown in FIG. 7, while reference position pulses in the detection signal corresponding to reference positions R1, R2 and R3 each have a width corresponding to a rotary angle of 15°, the home position pulse has a width of more than 45°. The purpose of the reference position pulses in the detection signal is to allow for checking whether or not the cam 34 and the cam plates 45 and 51 are correctly turned in response to a rotation of motor 32.

Figure 8:
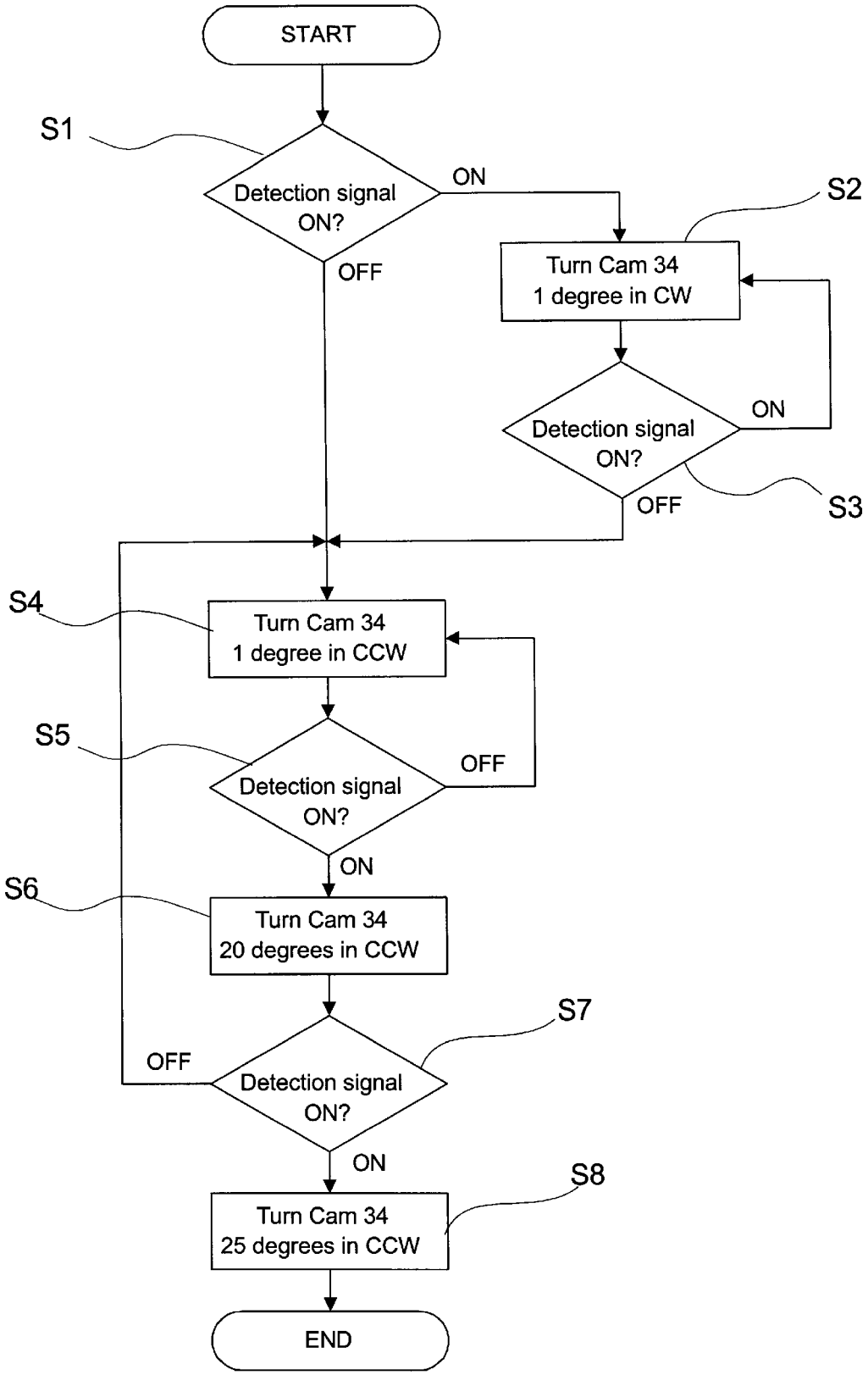
FIG. 8 is a flow chart illustrating an initialization process.

When the printer is switched on, the printer is set to the initialization state T0, as depicted in the flowchart shown in FIG. 8. In step S1 it is checked whether the detection signal in ON of OFF. If it is on, the rotary position of cam 34 is either the home position HP or any of the reference positions R1 to R3. In this case stepping motor is driven to turn cam 34 in steps of 1° in the clockwise direction until the detection signal becomes OFF (steps S2 and S3). Immediately before step S4 the rotary position of cam 34 is positioned between the home position and reference position S3 or between two of the reference positions. In steps S4 and S5 stepping motor 32 is driven to turn cam 34 in steps of 1° in the counterclockwise direction until the detection signal becomes ON which indicates a rotary position corresponding to any of the left-hand edges of the four ON pulses of the detection signal shown in FIG. 7. In step S6 stepping motor is driven in the counterclockwise direction to turn cam 34 by 20°. If this results in the detection signal becoming OFF, the cam 34 is positioned on the right-hand side of any of the reference positions and the procedure jumps back to step S4.

Otherwise, the rotary position of cam 34 is about 320°. By additionally turning cam 34 by 25° in step S8 the initialization state T0 is reached.

When an operator inserts a slip form 5 into paper supply opening 3 with the printer thus initialized, slip form 5 is pushed in until it contacts paper stop 42 and is thus set.

The controller drives stepping motor 32, when the controller detects slip form 5 by means of a paper sensor disposed in the transportation path and has confirmed that ink jet head 8 is held at its standby position (11C).

When stepping motor 32 is driven (clockwise), cam 34 rotates, and the two cam plates 45 and 51 connected thereto also turn. As a result, pinch roller 41*b* begins moving toward drive roller 41*a* at rotary position T1 in FIG. 7, while paper stop 42 begins rotating in a direction opening the transportation path.

At rotary position T2, pinch roller 41*b* reaches a position at which it presses the inserted slip form 5 with a constant pressure against drive roller 41*a*, and is held in this position. The paper stop 42 has returned to its open position and is held in this position so that the transportation path is completely open.

Next, at a point between rotary positions T2 and T3, a paper feed motor, not shown in the figures, is driven after confirming the "ON" status of the detection signal, and a first paper feed operation is accomplished (shown as "Paper indexing 1" in FIG. 7). More specifically, drive roller 41*a* is rotated by the paper feed motor not shown in the figures. Feed roller 21*a* of primary feed roller pair 21 is also rotated at the same time. The paper feed distance at this time is set so that the leading edge advances to just before entering the transportation path 11E downstream of printing region 11.

Thereafter, from rotary position T3, slider 36 begins to slide with the rotation of cam 34, and guide plate 31 begins to be gradually lifted toward printing region 11. At rotary position T4, guide plate 31 is completely exposed and is opposite guide surface 11D at printing region 11. This is the condition shown in FIGS. 4(A) and 4(B).

It should be noted here that when guide plate 31 moves, the slip form 5 is also transported by means of roller pairs 21 and 41 as noted above. That is, a second paper feed operation is accomplished ("Paper indexing 2"). By appropriately setting the pitch of cam groove 34*a* in cam 34, the slip form 5 and guide plate 31 can be moved in synchronization with the leading edge of the transported slip form 5 held precisely between guide surface 11D and paper presser surface 31*d* on the end of guide plate 31.

When movement of guide plate 31 then stops, the transported slip form 5, held with the leading edge thereof disposed between guide surface 11D and the presser surface 31*d*, reaches transportation path 11E downstream of printing region 11, and is thus guided into transportation path 11E. Pinch roller 41*b* then separates from drive roller 41*a* between rotary positions T5 and T6. As a result, the leading edge of slip form 5 passes printing region 11 and advances to transportation path 11E downstream therefrom, that is, slip form 5 is positioned at the starting position of the printing operation.

Thereafter, stepping motor 32 is reversed and rotated through a predetermined number of steps so as to return the components to rotary position T0. At this time paper stop 42 is rotated by means of coil spring 46 in the direction closing the transportation path, and despite slip form 5 being nipped between the end of the paper stop and the paper guide plate 13, it can be transported with no problem because the spring tension is set so as not to hinder paper transportation.

When it is confirmed that the detection signal is "ON", i.e. cam 34 has in fact been rotated into its home position HP and guide plate 31 is, thus, in its retracted position hidden behind support plate 37 as in FIG. 3(B), carriage 7 is driven, ink jet head 8 is moved from its standby position (11C) and the slip form 5 is printed as desired. The slip form 5 is ejected after the printing operation is completed by repeating the printing and slip form 5 transportation operations.

At a point just before the trailing edge of the printed slip form 5 separates from the primary feed roller pair 21, the paper ejection roller pair 22 disposed downstream of printing region 11 closes. As a result, the ejected slip form 5 is passed from primary feed roller pair 21 to this paper ejection roller pair 22, and is thereby completely ejected.

A first control method for transportation of a slip form inserted to paper supply opening 3 having been described so far, a modification will be described below as a second control method.

With the printer in the initialization state T0, the operator inserts a slip form 5 into paper supply opening 3 pushing it up to the paper stop 42.

Stepping motor 32 is then driven, turning cam 34 and cam plates 45 and 51 via rotary position T1 in FIG. 7 to T2 and T3. The pinch roller 41*b* moves to drive roller 41*a* and slip form 5 is pinched therebetween, and paper stop 42 then rotates to open the transportation path.

Next, a paper feed motor is driven to rotate drive roller 41*a*, and advance slip form 5 to immediately before transportation path 11E ("Paper indexing 1"). The slip form 5 is not restricted at this time because guide plate 31 has not moved opposite guide surface 11D yet.

Next, stepping motor 32 is driven, turning cam 34 and cam plates 45 and 51 to rotary position T6, and lifting guide plate 31 to guide surface 11D thereby forming a paper transportation path whose both sides are defined by guide plate 31 and guide surface 11D, respectively. Even if slip form 5 is folded or curved towards ink jet head 8, slip form 5 is restricted to a paper transportation path of which both sides are closed the path being temporarily formed using guide plate 31.

When the paper feed motor is then driven again, the leading edge of slip form 5 will be introduced into transportation path 11E because the side towards ink jet head 8 is covered by the movable guide plate 31 ("Paper indexing 2"). As a result, slip form 5 can be passed to paper ejection roller pair 22 without being affected by curling or wrinkling of the form, just as in the first control method in which the operation "paper indexing 2" is performed simultaneously with the lifting of the guide plate 31 as described above.

Stepping motor 32 is then driven so that the rotary position of cam 34 and cam plates 45 and 51 is returned from T6 to T1 so as to return the guide plate 31 to its retracted position. Thereafter, ink jet head 8 is moved from its standby position (11C), and printing is started. The eject operation is the same as with the above-noted first control method, that is, just before the trailing edge of slip form 5 separates from primary feed roller pair 21, paper ejection roller pair 22 closes.

In the second control method, the pitch of the cam groove in cam 34 need not be designed so as to synchronize movement of the guide plate 31 with the paper transport because the guide plate 31 and paper feed motor are not simultaneously driven. The peak current demand can therefore be lowered, which has the effect of reducing size and cost of the printer due to reducing the size of the power supply.

By returning the paper ejection roller pair 22 to the open state after ejecting the paper, the initialization state can be resumed in both control methods described above.

It should be noted that the operating mode of guide plate 31, pinch roller 41*b*, and paper stop 42 as described above can be realized by appropriately configuring the power transfer mechanism for driving said components, specifically in this embodiment by defining the contour of the cam surface on the peripheral surface of the cam plates 45 and 51, and the cam groove of cam 34.

It has been described above that the ink jet head is held in its standby position in front of the capping surface 11C until the leading edge of a slip form 5 inserted into the paper supply opening 3 is transported to a position beyond printing region 11. The purpose of keeping ink jet head in this position is to avoid interference between the ink jet head and the guide plate 31. This purpose may also be achieved by positioning the ink jet head at any other position along its range of motion which is laterally outside of the locus of the guide plate 31.

As described above, when an ink jet head or other print head of a printer comprising a guide plate mechanism according to the present invention is retracted to a retraction or standby position in the carriage movement direction, which is also the direction of the printing operation, a guide plate is activated, i.e., moved to a position for guiding recording paper past the printing region to the downstream side thereof. As a result, the gap (platen gap) between the print head and the paper guide surface is always held constant, unlike conventional configurations in which the print head is tilted away from the paper guide surface when a guide plate is activated. As a result, problems such as a drop in print quality caused by this gap changing do not occur.

In addition, because the carriage mechanism accomplishes the print head retracting operation when the guide plate is activated, it is not necessary to provide a separate drive mechanism for retracting the print head, and it is therefore also not necessary to reserve space for retracting the print head from the printing position. As a result, the apparatus can be made much more compact and costs can be lowered.

While the invention has been described in conjunction with several specific embodiments, it is evident to those skilled in the art that many further alternatives, modifications and variations will be apparent in light of the foregoing description. Thus, the invention described herein is intended to embrace all such alternatives, modifications, applications and variations as may fall within the spirit and scope of the appended claims.

What is claimed is:

1. A printer comprising:

a recording medium guide surface to define a printing region;

a print head disposed opposite to said recording medium guide surface having a predetermined gap therebetween and said print head moves solely in a substantially parallel direction to said recording medium guide surface along the printing region and beyond the printing region to a capping position;

a recording medium guide to guide a recording medium to the printing region and to expose the recording medium to said print head in the printing region, said recording medium guide comprising a guide plate movable between a first position being disposed opposite to the recording medium guide surface so as to guide the recording medium past the printing region, and a second position in which said recording medium guide is retracted from said printing region; and a drive source to move said guide plate from the first position to said second position only when the print head is in the capping position, said drive source comprising a motor and a cam mechanism in communication with said guide plate.

2. The printer according to claim 1, wherein said guide plate is movable between the first and second positions substantially in a plane parallel to the recording medium guide surface.

3. The printer according to claim 1, wherein said guide plate comprises a continuous recording medium presser surface having a width greater than a maximum width of the recording medium, and extending towards the recording medium guide surface.

4. The printer according to claim 3, wherein said continuous recording medium presser surface is resiliently urged towards the recording medium guide surface.

5. The printer according to claim 1, wherein said cam mechanism converts a rotational movement of said motor into a linear reciprocating motion of said guide plate between the first and second positions.

6. The printer according to claim 1, further comprising:

a first pair of rollers switchable between a closed state engaging each other for transporting the recording medium to the printing region, and an open state separated from each other, a first mechanism to move said guide plate into the first position and returning said guide plate to the second position; and a second mechanism to switch said first pair of rollers between the closed state and the open state, wherein said drive source comprises a motor to drive both said first mechanism and said second mechanism so as to bring said first pair of rollers into the closed state and move said guide plate from the second to the first position in a sequential order.

7. A printer comprising:

a recording medium guide surface to define a printing region;

a print head disposed opposite to said recording medium guide surface having a predetermined gap therebetween and said print head moves solely in a substantially parallel direction to said recording medium guide surface along the printing region and beyond the printing region to a retracted position;

a recording medium guide to guide a recording medium to the printing region and to expose the recording medium to said print head in the printing region, said recording medium guide comprising a guide plate movable between a first position being disposed opposite to the recording medium guide surface so as to guide the recording medium past the printing region, and a second position in which said recording medium guide is retracted from said printing region;

a drive source to move said guide plate from the first position to said second position only when the print head is in the retracted position, wherein said drive source comprises a motor and a cam mechanism in communication with said guide plate, said cam mechanism converts a rotational movement of said motor into a linear reciprocating motion of said guide plate between the first and second positions; and a spring for biasing said guide plate into the second position.

8. A printer comprising:

a recording medium guide surface to define a printing region;

a print head disposed opposite to said recording medium guide surface having a predetermined gap therebetween and said print head moves solely in a substantially parallel direction to said recording medium guide surface along the printing region and beyond the printing region to a retracted position;

a recording medium guide to guide a recording medium to the printing region and to expose the recording medium to said print head in the printing region, said recording medium guide comprising a guide plate movable between a first position being disposed opposite to the recording medium guide surface so as to guide the recording medium past the printing region, and a second position in which said recording medium guide is retracted from said printing region; and a drive source to move said guide plate from the first position to said second position only when the print head is in the retracted position, wherein said drive source comprises a motor and a cam mechanism in communication with said guide plate, said cam mechanism converts a rotational movement of said motor into a linear reciprocating motion of said guide plate between the first and second positions, wherein said cam mechanism comprises:

a cylindrical cam adapted to be rotated by said motor and having a cam groove in its outer circumferential surface; and a slide pin adapted to slide in said cam groove and held in a manner enabling a linear reciprocating motion in the direction of a rotational axis of said cam, said guide plate being coupled to the slide pin.

9. A printer comprising:

a recording medium guide surface to define a printing region;

a print head disposed opposite to said recording medium guide surface having a predetermined gap therebetween and said print head moves in a parallel direction to said recording medium guide surface along the printing region and beyond the printing region to a retracted position;

a recording medium guide to guide a recording medium to the printing region and to expose the recording medium to said print head in the printing region, said recording medium guide comprising a guide plate movable between a first position being disposed opposite to the recording medium guide surface so as to guide the recording medium past the printing region, and a second position in which said recording medium guide is retracted from said printing region;

a drive source to move said guide plate from the first position to said second position only when the print head is in the retracted position;

a first pair of rollers switchable between a closed state engaging each other for transporting the recording medium to the printing region, and an open state separated from each other;

a first mechanism to move said guide plate into the first position and returning said guide plate to the second position;

a second mechanism to switch said first pair of rollers between the closed state and the open state, wherein said drive source comprises a motor to drive both said first mechanism and said second mechanism so as to bring said first pair of rollers into the closed state and move said guide plate from the second to the first position in a sequential order; and a recording medium stop and a third mechanism to move said recording medium stop between a first position in which said recording medium stop blocks a recording medium transportation path between said first pair of rollers and the printing region, and a second position in which said recording medium stop is retracted from said recording medium transportation path, said motor being adapted to also drive said third mechanism so as to bring said recording medium stop into a second position and move said guide plate into a first position in a sequential order.

10. The printer according to claim 9, wherein said second mechanism comprises a first disk-like cam plate in communication with said motor to convert the rotational movement of said motor into a movement of a first one of said first pair of rollers relative to a second one of said first pair of rollers and said third mechanism comprises a second disk-like cam plate to convert the rotational movement of said motor into a movement of said recording medium stop.

11. The printer according to claim 10, wherein said cam and said first and second cam plates are arranged in response to a rotation of said motor in a predetermined direction at a first angular position, said first one of said first pair of rollers starts moving from a position separated from said second one of said first pair of rollers in a direction towards said second one of said first pair of rollers, and said recording medium stop starts moving from the first position toward said second position;

at a second angular position, said first one of said first pair of rollers is placed in contact with said second one of said first pair of rollers, and said recording medium stop reaches the second position;

at a third angular position, said guide plate begins moving from the second position towards the first position; and at a fourth angular position, said guide plate is in the first position.

12. A printer comprising:

a recording medium guide surface to define a printing region;

a print head disposed opposite to said recording medium guide surface having a predetermined gap therebetween and said print head moves in a parallel direction to said recording medium guide surface along the printing region and beyond the printing region to a retracted position;

a recording medium guide to guide a recording medium to the printing region and to expose the recording medium to said print head in the printing region, said recording medium guide comprising a guide plate movable between a first position being disposed opposite to the recording medium guide surface so as to guide the recording medium past the printing region, and a second position in which said recording medium guide is retracted from said printing region;

a drive source to move said guide plate from the first position to said second position only when the print head is in the retracted position:

a first pair of rollers switchable between a closed state engaging each other for transporting the recording medium to the printing region, and an open state separated from each other:

a first mechanism to move said guide plate into the first position and returning said guide plate to the second position:

a second mechanism to switch said first pair of rollers between the closed state and the open state, wherein said drive source comprises a motor to drive both said first mechanism and said second mechanism so as to bring said first pair of rollers into the closed state and move said guide plate from the second to the first position in a sequential order;

a second pair of rollers disposed between said first pair of rollers and the printing region; and a third pair of rollers disposed downstream of the printing region, wherein when said second pair of rollers enables recording medium transportation, said third pair of rollers enables recording medium ejection at a point just before a trailing edge of the recording medium transported by said second pair of rollers exits said second pair of rollers.

13. A method of setting a recording medium in a printer comprising the steps:

(a) detecting insertion of the recording medium;

(b) checking whether a print head is in a retracted position and, if not, moving the print head to the retracted position while maintaining a predetermined gap between the print head and a guide surface, (c) moving a guide plate to a first position after confirming that the print head is in the retracted position;

(d) advancing a leading edge of recording medium to a printing region and along the guide plate past the printing region, (e) moving the guide plate to a second position, and (f) moving the print head to the printing region after confirming that the guide plate is in the second position, wherein one of (1) steps (a) to (f) are performed sequentially and (2) steps (a) to (c) and (d) to (f) are performed sequentially while steps (c) and (d) are performed substantially simultaneously.

* * * * *